US005427413A

United States Patent [19]

Garza

[11] Patent Number: 5,427,413

[45] Date of Patent: * Jun. 27, 1995

[54] INFORMATION PAD

[76] Inventor: Paul G. Garza, 12 Ollerton, Conroe, Tex. 77303

[ * ] Notice: The portion of the term of this patent subsequent to Oct. 29, 2008 has been disclaimed.

[21] Appl. No.: 95,913

[22] Filed: Jul. 23, 1993

Related U.S. Application Data

[63] Continuation-in-part of Ser. No. 974,967, Nov. 12, 1992, Pat. No. 5,277,451, which is a continuation-in-part of Ser. No. 923,216, Jul. 21, 1992, Pat. No. 5,222,763, which is a continuation-in-part of Ser. No. 684,218, Apr. 12, 1991, Pat. No. 5,135,259.

[51] Int. Cl.[6] ..... B42D 3/00

[52] U.S. Cl. ..... 281/29; 281/31; 283/58; 283/64.1

[58] Field of Search ..... 281/29, 31, 35, 15.1, 281/35, 39; 283/57, 58, 63.1, 64.1, 64; 150/135; 434/410

[56] References Cited

U.S. PATENT DOCUMENTS

| | | | |
|---|---|---|---|
| 4,566,721 | 1/1986 | Friedman et al. | 281/31 |
| 4,911,476 | 3/1990 | Garza | 281/29 |
| 5,060,979 | 10/1991 | Garza | 281/29 X |
| 5,135,259 | 8/1992 | Garza | 281/29 |
| 5,277,451 | 1/1994 | Garza | 281/29 |

*Primary Examiner*—Willmon Fridie
*Attorney, Agent, or Firm*—Harrison & Egbert

[57] ABSTRACT

An information pad for checkbooks including a cover of a flexible foldable plasticized material, a plurality of sheets affixed together along a common edge, a backing layer affixed to the plurality of sheets and having a front side and a back side, and a hinge member affixed to the backing layer and extending outwardly beyond the common edge of the plurality of sheets. The hinge member is adhesively affixed to the cover. The cover is a checkbook cover. The hinge member has an adhesive strip extending thereacross for engaging the cover. The hinge member is affixed to the back side of the backing layer. The frontal surface of the hinge member has a display area formed thereon for the display of advertising indicia. The hinge member has a length corresponding to an edge length of the backing layer.

20 Claims, 2 Drawing Sheets

INFORMATION PAD

RELATED APPLICATIONS

The present application is a continuation-in-part of U.S. patent application Ser. No. 07/974,967, filed on Nov. 12, 1992, now U.S. Pat. No. 5,277,451. U.S. application Ser. No. 07/974,967 was a continuation-in-part of U.S. patent application Ser. No. 07/923,216, filed on Jul. 21, 1992, and entitled "Notepad", issued as U.S. Pat. No. 5,222,763 on Jun. 29, 1993. U.S. application Ser. No. 07/923,216 was a continuation-in-part of U.S. patent application Ser. No. 07/684,218, filed on Apr. 12, 1991, and entitled "Notepad for Checkbooks". U.S. application Ser. No. 07/684,218 issued as U.S. Pat. No. 5,135,259 on Aug. 4, 1992.

TECHNICAL FIELD

The present invention relates to notepads. More particularly, the present invention relates to checkbooks having information pads attached thereto.

BACKGROUND ART

In present checkbooks, it is often difficult to carry out computations, record information, and otherwise balance the checkbook without having an adjacent sheet of paper. Many times, checkbook users must conduct mathematical computations in the margins surrounding checkbooks, or in the ledger portion of checkbooks. Beyond the unsightly appearance of such margin calculations, these additional markings can create problems for banks and other persons that would process such checks. The appearance of these unsightly calculations within the ledger sheet could confuse the user and cause miscalculations in balancing one's checkbook.

Many present day checkbooks incorporate a calculator within the checkbook cover. Although this aids in the computation of various matters associated with checking activities, calculators are cumbersome and will not record a variety of information. In addition, calculators cannot be easily folded or stuffed into one's pocket haphazardly. Many times, calculators will run out of power, or will become defective with use. The use of calculators in conjunction with checkbooks is a costly endeavor by the checkbook manufacturer and is generally found to be unsuitable for consumer use.

U.S. Pat. No. 4,911,476, issued on Mar. 27, 1990 to Raul G. Garza, the present inventor, incorporated a "magic slate" type of arrangement within a checkbook cover. After extensive usage, it was found that this "magic slate" was easy to incorporate into the checkbook. Specifically, the space was available which allowed the magic slate to be suitably folded within the confines of the cover of the checkbook. The magic slate was positioned so that the marking of the ledger or the marking of checks would not transmit written information onto the magic slate. Also, the magic slate could be stored such that the recorded information would no be erased by the separation of the associated impression layers of the magic slate. This was an extremely convenient arrangement for checkbook users.

U.S. Pat. No. 5,060,979, issued on Oct. 29, 1991, to the present inventor, describes an information pad for checkbooks. In particular, this invention utilizes a notepad having an adhesive hinge extending from a back surface of the notepad. The "adhesive hinge" fastens along an outer periphery of the plastic checkbook cover. In this manner, the notepad can fold inwardly or outwardly from the checkbook so as to provide a writing surface for persons utilizing the checkbook. After the notepad .has been exhausted of its sheets of paper, the adhesive section may be removed so as to separate the notepad from the checkbook. A replacement notepad can be inserted in place of the original notepad.

U.S. Pat. No. 5,222,763, issued on Jun. 29, 1993, to the present inventor, describes a notepad having a plurality of sheets affixed together along a common edge and a backing layer affixed to the plurality of sheets. The sheets are adhered together by an adhesive having a quality suitable for permitting the separation of on sheet from another without tearing. In particular, such a grouping of sheets are commonly known as "POST-IT" (TM) pads. The backing layer has one surface dimension greater than a corresponding surface dimension of the plurality of sheets so as to form a display extending outwardly of the plurality of sheets. A score line extends across the display area to define an upper and lower portion. The upper portion of the display area is foldable relative to the lower portion of the display area. The display area is suitable for receiving advertising indicia printed thereon. This notepad is very useful in conjunction with checkbooks, notebooks, and other items which include a slot for receiving a portion of the backing of the pad. However, it does have limited effectiveness when used on covers not having a slot for receiving a portion of the backing layer.

It is an object of the present invention to provide an information pad for use in conjunction with a checkbook or other type of book.

It is another object of the present invention to provide an information pad that is attached to the checkbook or other book in a simple manner.

It is still a further object of the present invention to provide an information pad that is very inexpensive, easy to manufacture, and easily utilized.

These and other objects and advantages of the present invention will become apparent from a reading of the attached specification and appended claims.

SUMMARY OF THE INVENTION

The present invention is an apparatus including a cover of a flexible foldable plasticized material, a plurality of sheets affixed together along a common edge, a backing layer affixed to the plurality of sheets and having a front side and a back side, and a hinge member affixed to the backing layer and extending outwardly beyond the common edge of the plurality of sheets. The hinge member is adhesively fastened to the cover. The plurality of sheets reside adjacent to the front side of the backing layer. The cover is specifically a checkbook cover.

The hinge member has an adhesive strip extending thereacross. This adhesive strip serves to engage the cover. The adhesive strip has an adhesive strength of between five ounces per inch of width and eighty five ounces per inch of width. The hinge member is either affixed to the back side of the backing layer or is integrally connected to the backing layer. The hinge member has a frontal surface and a rear surface. The frontal surface is affixed to the back side of the backing layer. The adhesive strip extends across the rear surface of the hinge member. The frontal surface has a display area formed thereon. This display area has advertising indicia printed thereon. The hinge member has a length corresponding to an edge length of the backing layer.

The hinge member may be made of a flexible polymeric material.

In the embodiment of the present invention, the term "checkbook cover" is employed throughout. Such a term is not intended as a limitation of the present invention to specifically "checkbook covers". Rather, the notepad of the present invention is applicable to a wide range of covered items, similar to checkbook covers. For example, the adhesive strip can be useful in connection with application to DAY TIMERS (TM), to notepads, to notebooks, and to other types of covered books. As such, the "checkbook" should not be construed as a term of specific limitation.

In an alternative embodiment of the present invention the present invention is a notepad comprising a plurality of sheets affixed together along a common edge, a backing layer affixed to the plurality of sheets, and a hinge member affixed to the backing layer and extending outwardly beyond the common edge of the plurality of sheets. The hinge member has an adhesive strip extending across a surface of the hinge member. The adhesive strip can be suitable for removable attachment a variety of surfaces.

DETAILED DESCRIPTION OF THE INVENTION

Figure 1:
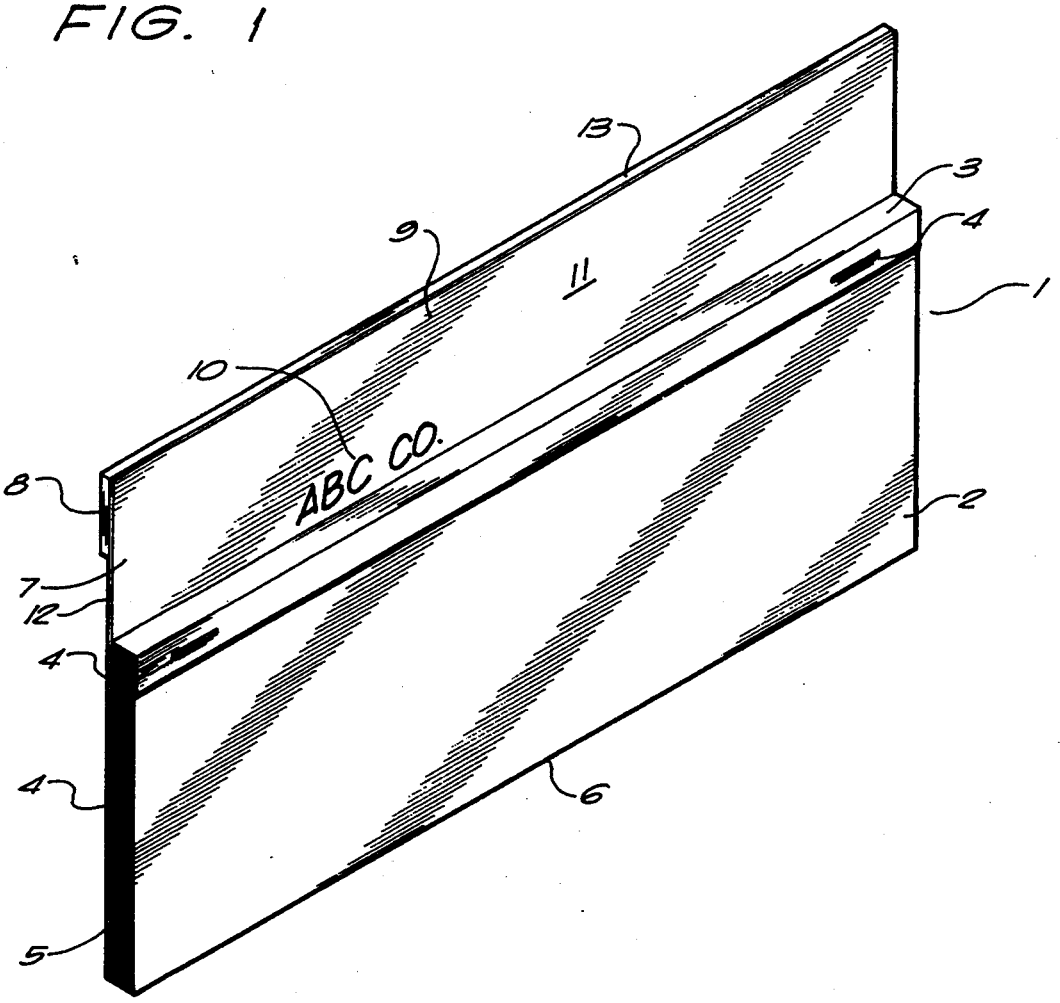
FIG. 1 is a perspective view of the notepad in accordance with the preferred embodiment of the present invention.

Referring to FIG. 1, there is shown at 1 the preferred embodiment of the notepad in accordance with the present invention. It can be seen that the notepad 1 includes a plurality of sheets 2 which are adhesively affixed together along a common edge 3. The plurality of sheets 2 can be affixed together by adhesive or can be affixed together by mechanical means such a staples 4. Additionally, perforations or scoring can be employed so as to allow the sheets of the plurality of sheets 2 to be easily removed from the notepad 1. If the plurality of sheets 2 are joined by an adhesive, these plurality of sheets 2 can be in the form of "POST-IT" (TM) pads.

In FIG. 1, it can be seen that there is a backing layer 4 which is affixed to the plurality of sheets 2. The backing layer 4 has a front side 5 and a back side. The plurality of sheets 2 are affixed adjacent to the front side 5 of the notepad 1. It can be seen that the backing layer 4 has a length generally corresponding to the length of the plurality of sheets 2. The bottom edge of the backing layer 4 is flush with the bottom edge 6 of the plurality of sheets 2.

In the embodiment shown in FIG. 1, a hinge member 7 extends outwardly from the backing layer 4. Specifically, in this embodiment, the hinge member 7 is integrally affixed to the backing layer 4. The hinge member 7 extends outwardly beyond the common edge 3 of the plurality of sheets 2. The hinge member 7 has an adhesive strip 8 extending across a surface of the hinge member 7. As can be seen, the hinge member 7 extends outwardly so as to have a display area 9. Advertising indicia 10 are provided on the display area 9. The hinge member 7 has a frontal surface 11 and a rear surface 12. The adhesive strip 8 is positioned on the rear surface 12 and extends thereacross adjacent to the top 13 of the hinge member 7. The advertising indicia 10 are printed on the frontal surface 11 of the hinge member 7. The hinge member 7 has a length generally equal to the length of the backing layer 4.

In FIG. 1, it can be seen that the backing layer 4 has a width which is flush with the width of the plurality of sheets 2. Additionally, the bottom edge of the backing layer 4 is flush with the bottom edge 6 of the plurality of sheets 2. In this manner, the notepad 1 has a neat and attractive appearance.

Figure 2:
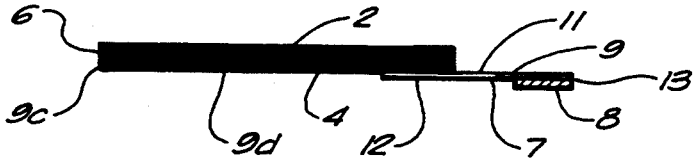
FIG. 2 is a side elevational view of the notepad of the present invention.

FIG. 2 shows the arrangement of the plurality of sheets 2 with respect to the backing layer 4. In general, the backing layer 4 will have greater rigidity than any of the individual sheets within the plurality of sheets 2. The bottom edge **9*c* of the backing layer 4 is shown as flush with the bottom edge 6 of the plurality of sheets 2. The display area 9 is appropriately printed on the frontal surface 11 of the hinge member 7. The back surface 9*d* of the backing layer 4 is generally flat. However, in either of the embodiments of the present invention, the back surface 9*d* of the backing layer 4 may extend outwardly integrally connected with the hinge member 7**.

In FIG. 2, it can be seen that the lower part of the frontal surface 11 is adhesively connected to the back surface **9*d* of the backing layer 4. The hinge member 7 can be made of a flexible polymeric material. The adhesive used to fasten the hinge member 7 to the backing layer 4 should be of a quality so as to prevent the easy removal of the plurality of sheets 2 from the hinge member 7. The adhesive strip 8 is affixed to the back surface 12 of the hinge member 7. Specifically, the adhesive strip 8 is positioned so as to be generally flush with the top edge 13 of the hinge member 7. The adhesive strip 8 should be of an adhesive strength which is generally less than the adhesive strength of the adhesive used to join the hinge member 7 to the backing layer 4. Ideally, the adhesive strip 8 should have an adhesive strength of less than five ounces per inch of width of the strip. Such an adhesive will allow the strip 8 to be fastened to another surface without a tearing of the surface. If the adhesive strip 8 is to be fastened to a plasticized material, then the adhesive strip 8** should have an adhesive strength of five ounces per inch of width and 85 ounces per inch of width.

Figure 3:
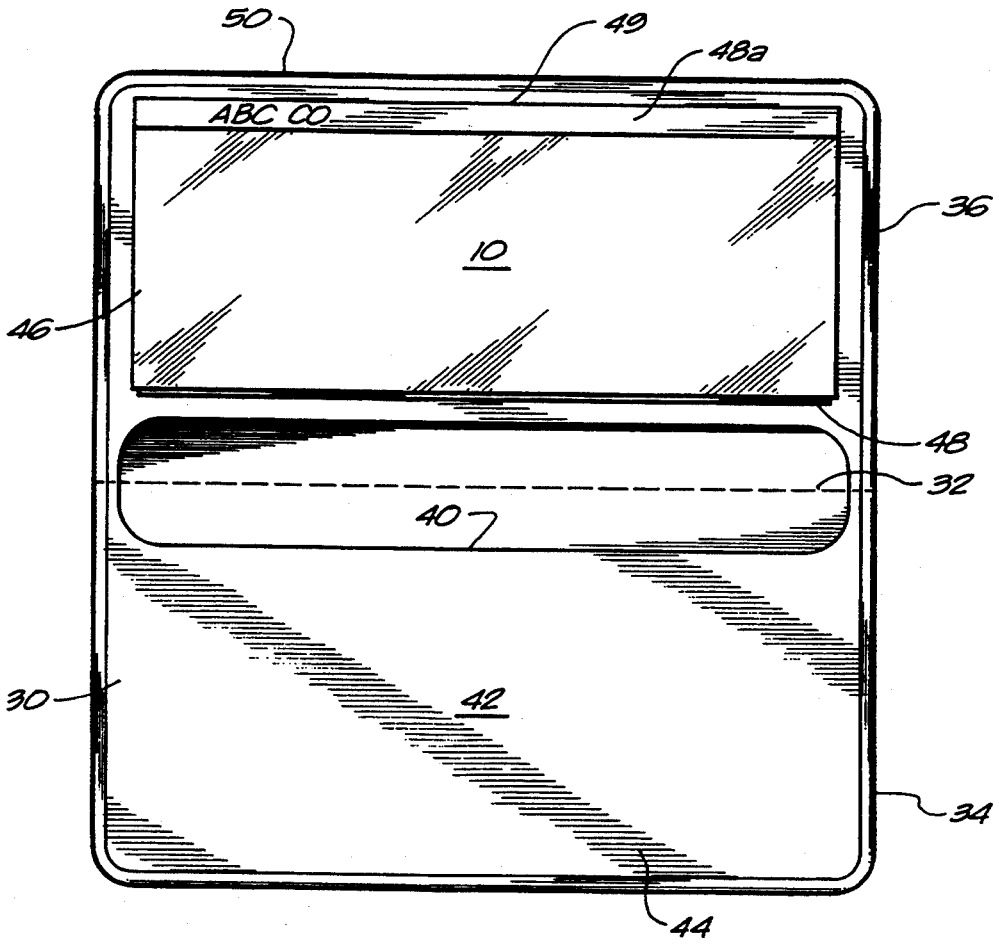
FIG. 3 illustrates the notepad as applied to a checkbook cover.

Referring to FIG. 3, the appearance of the checkbook cover 30 can be seen. In particular, it can be seen that the first section 34 and the second section 36 can be folded along fold line 32. A slot 40 is provided in the first section so as to receive the back cover of a checkbook. The checkbook will reside in area 32 on the first section 34. A plastic liner 44 may be provided on the inner surface of the checkbook cover 30. As can be seen, the checkbook cover 30 has a generally rectangular configuration. The notepad 10 is affixed to the surface of the second section 36 of the checkbook cover 30. A first sheet 46 is provided in a proper position for use by the user of the checkbook 30. All of the sheets 46 are connected along a common edge 49. After the first sheet 46 is used, the sheet can be removed so as to expose the second sheet 48 therebelow. Such a process continues until the notepad 10 is used up. After the notepad 10 is used up, the entire notepad 10 can be removed by pulling the backing layer, and the attached hinge member, from the adhesive attachment to the surface of the checkbook cover 30. In this configuration, the first section 34 and the second section 36 of checkbook cover 30 can be folded onto itself so as to cover the exposed portions of the notepad 10. When folded, the notepad 10 and a checkbook contained in slot 40 on surface 42 will be in face-to-face relationship. One important advantage of the present invention is that it has a flexible hinge to use as a locator, or, when the checkbook is opened, a writing pad is presented so as to face the user. Alternatively, the adhesive strip of the hinge member 48*a* can be realized so that the notepad 10 extends outwardly beyond the edge 50 of the checkbook cover 30.

The present invention offers an improved notepad. In particular, the present invention utilizes a backing layer and has an outwardly extending hinge portion. A display area is formed on this outwardly extending portion which is suitable for the receipt of advertising and/or other indicia. The hinge member has a quality suitable for adherence to checkbooks, notebooks, book covers, or to notepads. The configuration of the notepad of the present invention can be a manufactured and assembled relatively inexpensively.

The foregoing disclosure and description of the invention is illustrative and explanatory thereof. Various changes in the details of the illustrated apparatus may be made within the scope of the appended claims without departing from the true spirit of the invention. The present invention should only be limited by the following claims and their legal equivalents.

I claim:

1. An apparatus comprising:

a cover of a flexible foldable plasticized material;

a plurality of sheets affixed together along a common edge;

a backing layer affixed to said plurality of sheets, said backing layer having a front side and a back side, said plurality of sheets adjacent said front side; and a hinge member affixed to said backing layer and extending outwardly beyond said common edge of said plurality of sheets, said hinge member adhesively affixed to said cover.

2. The apparatus of claim 1, said cover being a checkbook cover.

3. The apparatus of claim 1, said hinge member having an adhesive strip extending thereacross, said adhesive strip engaging said cover.

4. The apparatus of claim 3, said adhesive strip having an adhesive strength of between five ounces per inch width and eighty five ounces per inch of width.

5. The apparatus of claim 3, said hinge member affixed to said back side of said backing layer.

6. The apparatus of claim 5, said hinge member having a frontal surface and a rear surface, said frontal surface affixed to said back side of said backing layer, said adhesive strip extending across said rear surface.

7. The apparatus of claim 1, said front side having a display area formed thereon, said display area having advertising indicia printed thereon.

8. The apparatus of claim 1, said hinge member integrally connected to said backing layer. .

9. The apparatus of claim 1, said hinge member being of a flexible polymeric material.

10. The apparatus of claim 1, said hinge member having a length corresponding to an edge length of said backing layer.

11. A notepad comprising:

a plurality of sheets affixed together along a common edge;

a backing layer affixed to said plurality of sheets, said backing layer having a front side and a back side, said plurality of sheets adjacent said front side; and a hinge member affixed to said backing layer and extending outwardly beyond said common edge of said plurality of sheets, said hinge member having an adhesive strip extending across a surface of said hinge member.

12. The notepad of claim 11, said hinge member having a length corresponding to an edge length of said backing layer.

13. The notepad of claim 11, said hinge member being of a flexible polymeric material.

14. The notepad of claim 13, said hinge member affixed to said back side of said backing layer.

15. The notepad of claim 14, said hinge member having a frontal surface and a rear surface, said frontal surface affixed to said back side of said backing layer, said adhesive strip extending across said rear surface.

16. The notepad of claim 15, said frontal surface having a display area formed thereon, said display area having advertising indicia printed thereon.

17. The notepad of claim 11, said backing layer having a width equal to a length of said common edge.

18. The notepad of claim 11, said hinge member integrally connected to said backing layer.

19. The notepad of claim 11, said plurality of sheets being adhesively affixed together, said plurality of sheets having an adhesive of a quality suitable for separating one sheet from another without tearing.

20. The notepad of claim 11, said adhesive strip having an adhesive strength of less than five ounces per inch of width of said strip.

* * * * *